US011427438B2

(12) United States Patent
Lodi

(10) Patent No.: US 11,427,438 B2
(45) Date of Patent: Aug. 30, 2022

(54) BRAKING UNIT FOR A STAIRLIFT

(71) Applicant: EXTREMA S.R.L., Bagnolo San Vito (IT)

(72) Inventor: Federico Lodi, Fabbrico (IT)

(73) Assignee: EXTREMA S.R.L., Bagnolo San Vito (IT)

( * ) Notice: Subject to any disclaimer, the term of this patent is extended or adjusted under 35 U.S.C. 154(b) by 319 days.

(21) Appl. No.: 16/756,321

(22) PCT Filed: Oct. 16, 2018

(86) PCT No.: PCT/IB2018/058000
§ 371 (c)(1),
(2) Date: Apr. 15, 2020

(87) PCT Pub. No.: WO2019/077481
PCT Pub. Date: Apr. 25, 2019

(65) Prior Publication Data

US 2020/0277161 A1 Sep. 3, 2020

(30) Foreign Application Priority Data

Oct. 17, 2017 (IT) ..... 102017000117293

(51) Int. Cl.
*B66B 5/22* (2006.01)
*B66B 5/04* (2006.01)
(Continued)

(52) U.S. Cl.
CPC ..... *B66B 5/22* (2013.01); *B66B 5/044* (2013.01); *B66B 5/20* (2013.01); *B66B 9/08* (2013.01)

(58) Field of Classification Search
CPC ..... B66B 5/044; B66B 9/08; B66B 5/20
See application file for complete search history.

(56) References Cited

U.S. PATENT DOCUMENTS 6,659,230 B1 * 12/2003 Jenkins ..... B66B 9/08 187/202
9,663,326 B2 * 5/2017 Osmanbasic ..... B66B 5/18
(Continued)

FOREIGN PATENT DOCUMENTS

AT 508496 1/2011
EP 1149041 A1 10/2001

*Primary Examiner* — Diem M Tran
(74) *Attorney, Agent, or Firm* — Pearne & Gordon LLP

(57) ABSTRACT

A braking unit (4) for a stairlift, wherein the stairlift comprises a guide rail (2) and a braking carriage (1) slidable on the guide rail (2), the braking carriage (1) comprising the braking unit (4). The braking unit (4) comprises: a safety device (5) which can be moved to a safe condition to engage with the guide rail (2) blocking a sliding of the braking carriage (1); a detection device (6) designed to detect a speed of the braking carriage (1), when the braking carriage (1) slides on the guide rail (2), and is configured to connect to the safety device (5) to cause the movement of the safety device (5) in the safe condition, if the speed of the braking carriage (1) exceeds a predetermined maximum speed. The safety device (5) comprises a safety rotor (501). The detection device (6) comprises: a friction rotor (601), rotating relative to the safety rotor (501) around a first axis of rotation (R1) by the sliding of the braking carriage (1); a variation mechanism (603) acting in conjunction with and coupled to the friction rotor (601) and is configured to connect in a rotationally integral matter the safety rotor (501) with the friction rotor (601) when the speed of the carriage (1) is greater than the predetermined speed. The safety rotor (501) is configured to be rotated around a second axis of rotation (R2), parallel to the first axis of rotation (R1) when the safety rotor (501) and the friction rotor (601) are connected in an integral manner, the safety device (5) also comprising a tapered element (506) fixed to the safety rotor (501) which is configured to be positioned between the
(Continued)

friction rotor (601) and the guide rail (2) for locking the safety device (5) in the safe condition and stopping the sliding of the braking carriage (1).

20 Claims, 8 Drawing Sheets

(51) Int. Cl.
*B66B 9/08* (2006.01)
*B66B 5/20* (2006.01)

(56) References Cited

U.S. PATENT DOCUMENTS

| | | | |
|---|---|---|---|
| 9,745,171 | B2 * | 8/2017 | Husmann ..... B66B 5/20 |
| 2008/0245617 | A1 | 10/2008 | Madoz Michaus et al. |
| 2012/0048652 | A1 | 3/2012 | DiGiovanni et al. |

* cited by examiner

BRAKING UNIT FOR A STAIRLIFT

This invention relates to a braking unit for a stairlift for use by persons with reduced mobility, wherein the stairlift comprises a braking carriage which includes the braking unit.

More specifically, the invention relates to a braking unit which includes a device for detecting a speed of the braking carriage and a safety device, configured for intervening and locking the braking carriage, if the detection device detects a speed which exceeds a predetermined speed.

A stairlift for use by persons with reduced mobility, configured to move a loading element, such as a child's seat or a platform for wheelchairs, is necessary to overcome architectural barriers of existing buildings, linked, for example, to the presence of a stairway or a ramp. A stairlift is therefore positioned for moving along an inclined plane and comprises at least a pair of guides, that is to say, a lower guide and an upper guide, and a movement unit to which the loading element is fixed. The movement unit comprises a drive carriage directly supported and movable on one of the guides, typically the lower guide, by means of a motor-driven drive device. The drive device may, for example, drive the drive carriage by means of a rolling element, for example by means of pinion-rack meshing mechanism or the like, or by adherence.

The movement unit also comprises a braking carriage, typically supported and movable on the other guide, typically, the upper guide, which moves in an integral manner with the drive carriage and the loading element and comprises a braking unit.

The stairlifts must comply with specific regulations which provide safety rules for the construction and installation of stairlifts in buildings. The safety rules currently in force require that the braking unit comprises a device for detecting a speed of the loading element, which is able to activate a safety device (also called a parachute) when the speed of the loading element exceeds a maximum permitted speed, for example due to a failure of the drive device which causes a free fall of the drive carriage. The safety device of the braking unit must stop the loading element itself within a specified space, interrupting simultaneously also a power supply to the motor.

The current regulations do not allow for a detection device or safety device of the electronic type, but only of the mechanical type.

According to a braking unit of known type both the upper guide and the bottom guide are equipped with a rack to guarantee the sliding and braking action of the braking carriage on the guide itself. Upon each intervention of the safety device, the safety device couples with the upper guide and the rack of the upper guide may be irreversibly damaged.

It should be noted that the upper guide is a handrail for use by persons without disabilities. The presence of the rack in the upper guide makes it difficult for a user to firmly hold the handrail and the handrail could even become dangerous if the rack were damaged due to a previous intervention of the safety device and has sharp parts.

An aim of this invention is to provide a braking unit for a stairlift which is free of the above-mentioned drawbacks.

This aim is achieved by the braking unit made according to claim 1 or one of the relative dependent claims.

Further features and advantages of this invention are more apparent in the detailed description below, with reference to a preferred, non-restricting, embodiment of a braking unit as illustrated in the accompanying drawings, in which.

Figure 1:
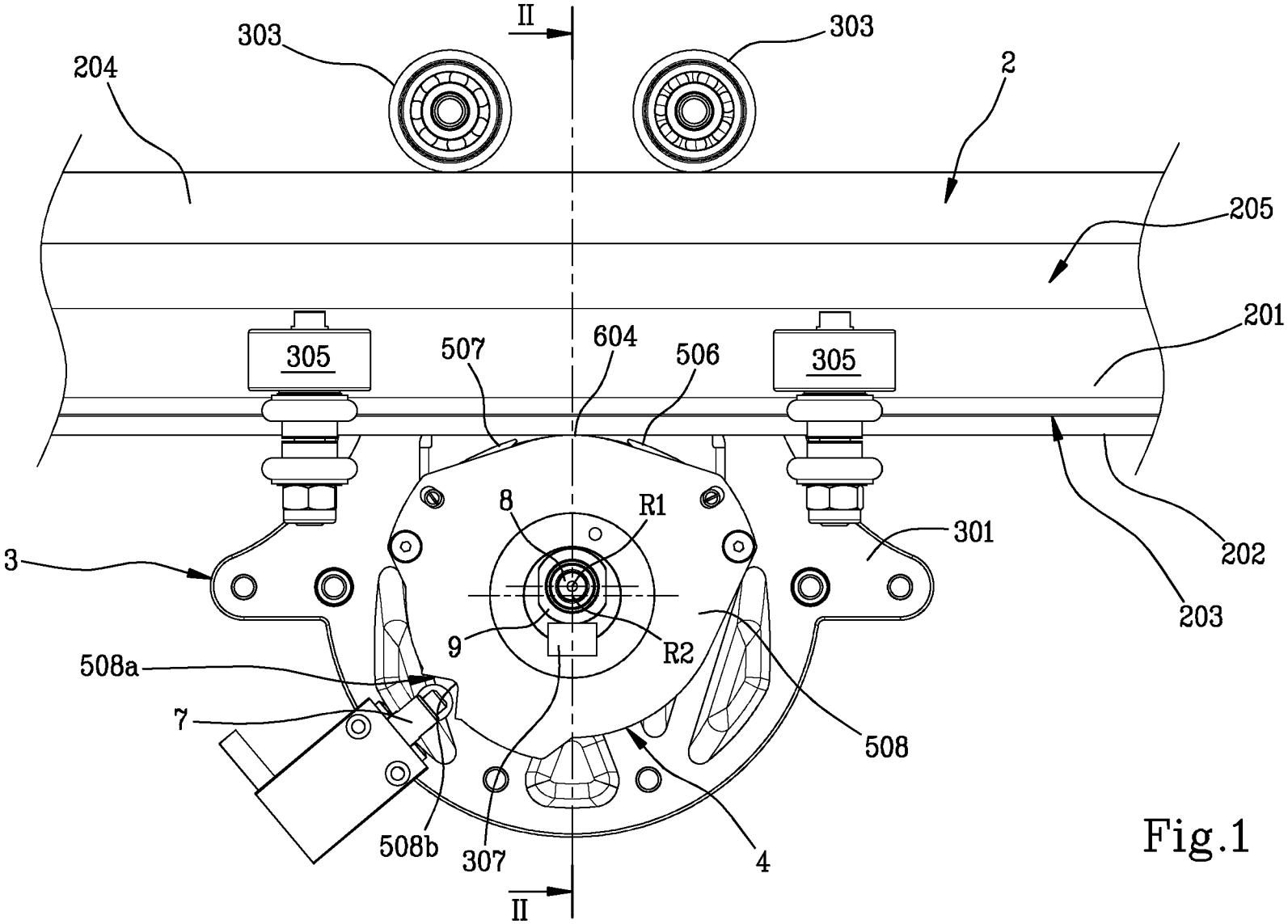
FIG. 1 is a front view of a braking carriage slidably mounted on a guide which comprises a sliding unit and a braking unit supported by the sliding unit, according to the invention, wherein some parts of the braking carriage have been removed, for clarity.
Figure 2:
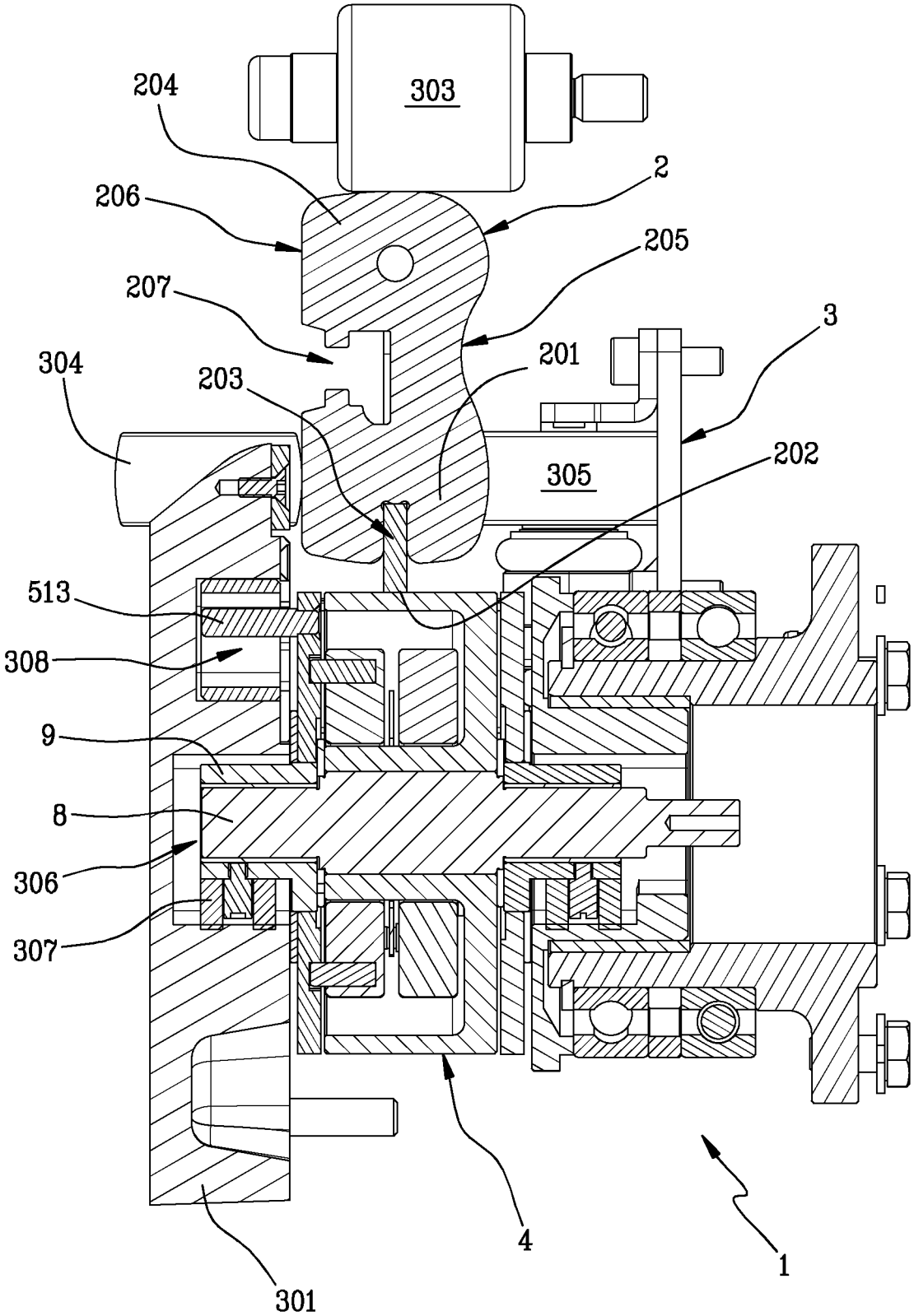
FIG. 2 is a cross-section view of the braking carriage of FIG. 1, along a line II-II of FIG. 1 in which some parts of the braking carriage have been removed, for clarity.
Figure 3:
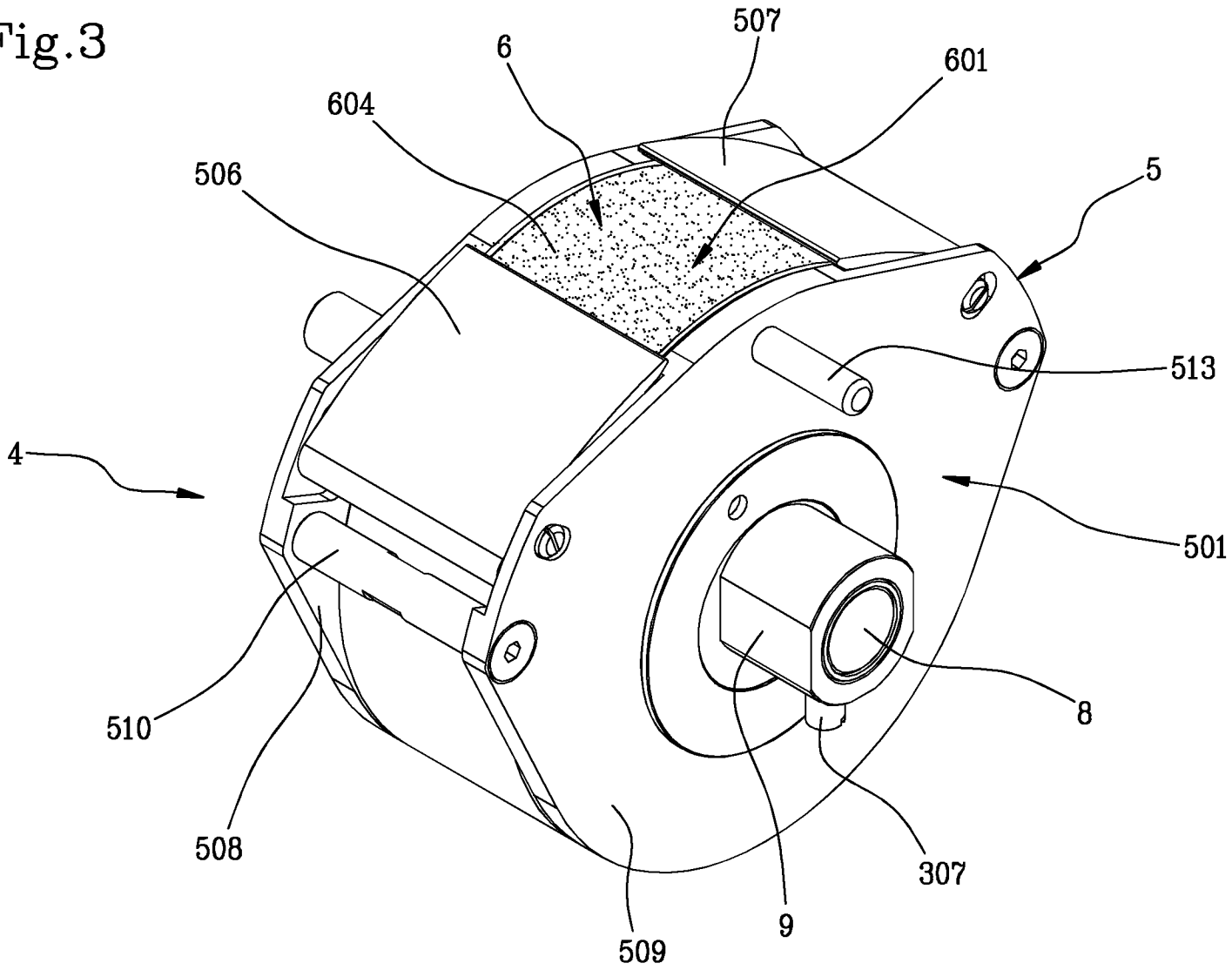
FIG. 3 is a rear axonometric view of the braking unit of FIG. 1.
Figure 4:
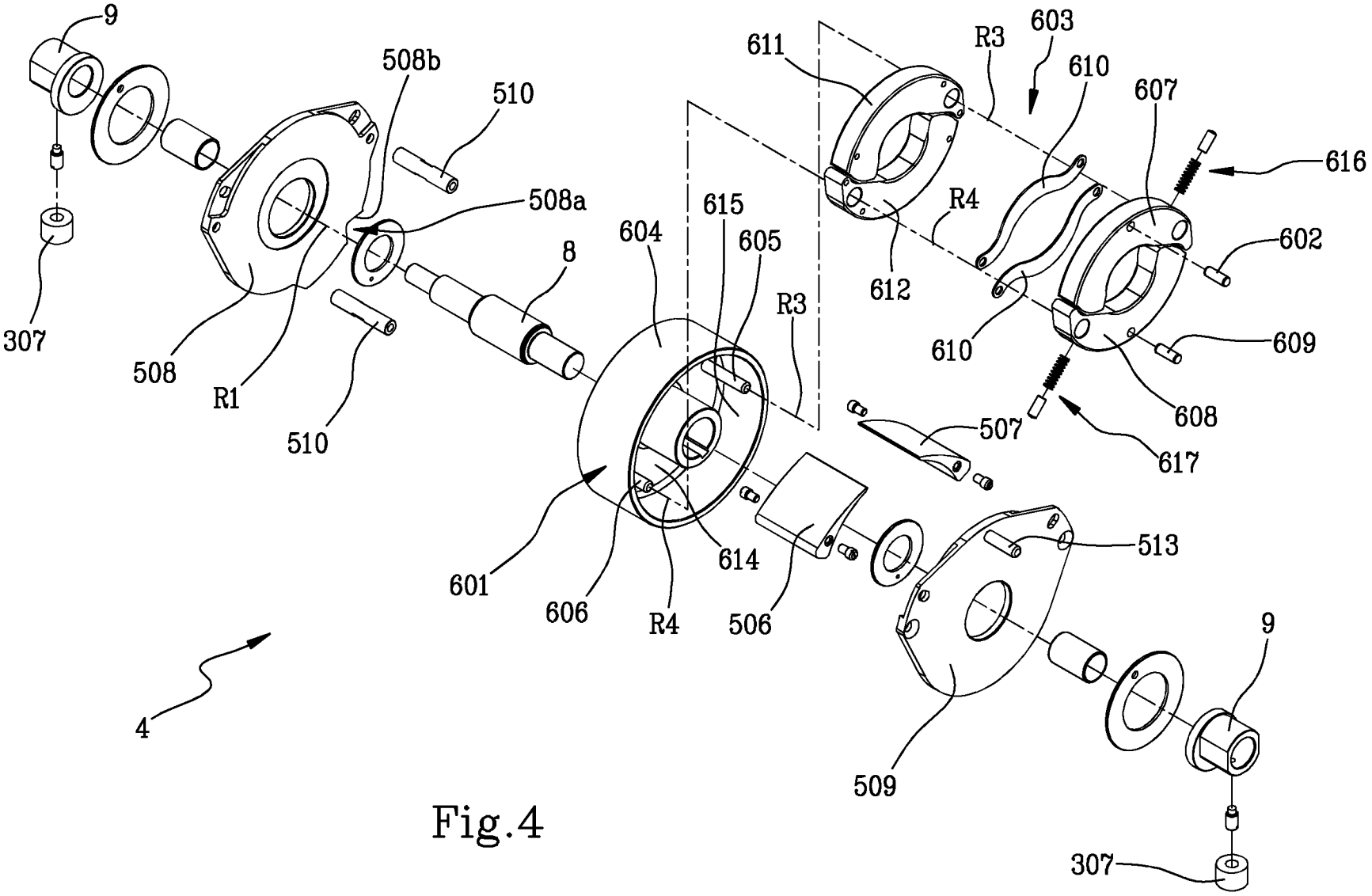
FIG. 4 is an exploded view of the braking unit of FIG. 3.
Figure 5:
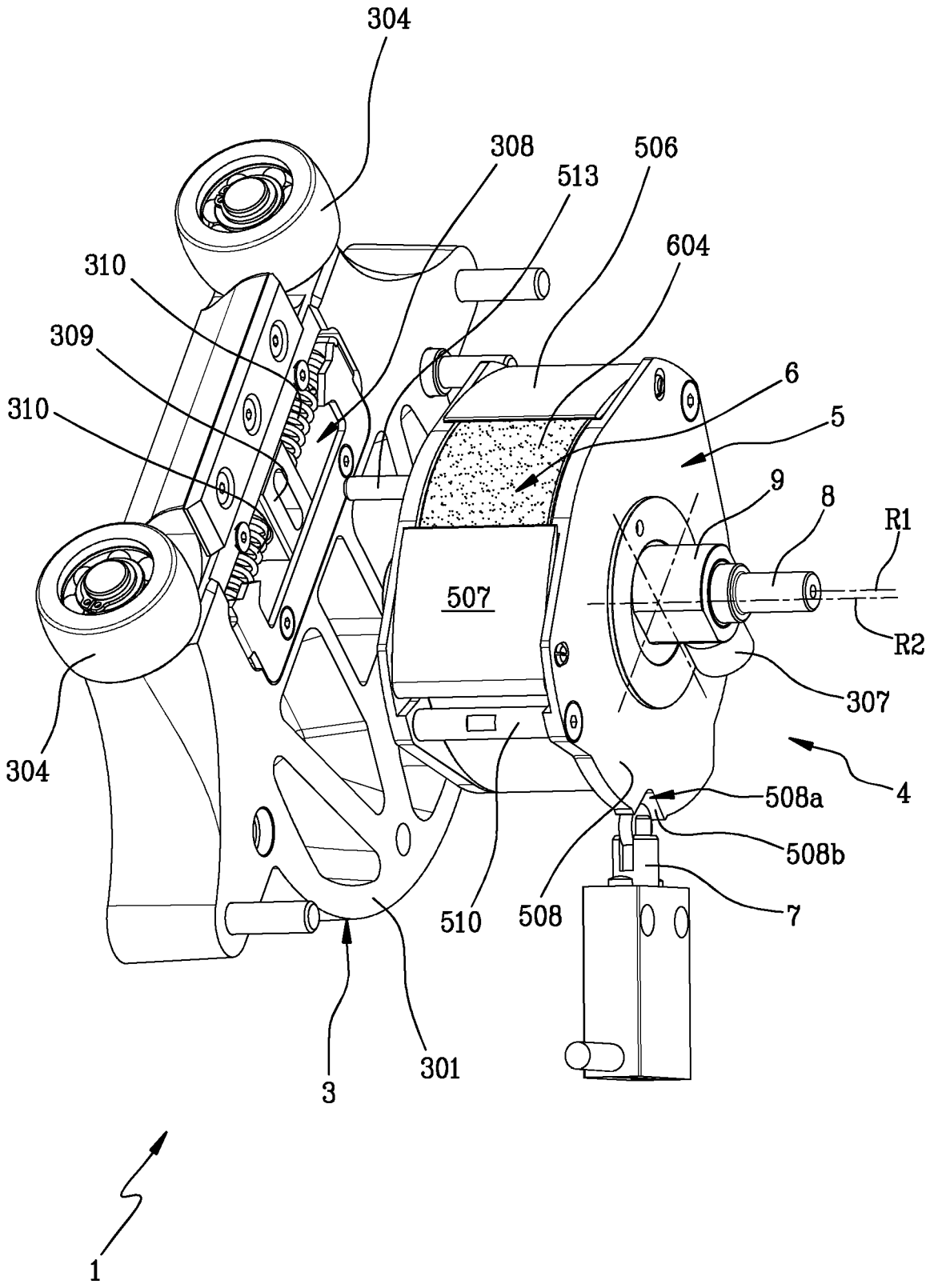
FIG. 5 is an axonometric view of the braking carriage of FIG. 1, in which some parts of the braking carriage have been removed, for clarity.

In FIGS. 1 to 8, the numeral 1 denotes in its entirety a braking carriage for a stairlift (not illustrated) for use by persons with reduced mobility.

The stairlift, as mentioned above, comprises the braking carriage 1 and a motor-driven drive carriage (not illustrated) which are respectively supported and moved in a sliding manner on a guide 2 and on a further guide (not illustrated). The braking carriage 1 moves in an integral manner with the drive carriage and with a loading element of the person, which is fixed to the drive carriage and to the braking carriage 1.

The braking carriage 1 comprises a sliding unit 3 configured for sliding on the guide 2 and a braking unit 4, supported by the sliding unit 3, which comprises a safety device 5, which can be moved to engage with the guide 2 from a sliding condition to a safe condition blocking a sliding of the braking carriage 1.

The braking unit 4 also comprises a detection device 6, which is configured for detecting a speed of the braking carriage 1, when the braking carriage 1 slides on the guide 2, and is connected to the safety device 5 to cause the movement of the safety device 5 to the safe condition, if the speed of the braking carriage 1 exceeds a predetermined maximum speed.

The safety device 5 comprises a safety rotor 501, configured for blocking a sliding of the braking carriage 1.

The detection device 6 comprises a friction rotor 601, which is moved by the sliding of the braking carriage 1 rotating independently from the safety rotor 501 about a first axis of rotation R1. In other words, the friction rotor 601 is moved in rotation by the sliding of the braking carriage 1 relative to the safety rotor 501.

The detection device 6 comprises, in addition, a variation mechanism 603, acting in conjunction with and coupled with the safety rotor 501.

The variation mechanism 603 is configured to connect in a rotationally integral manner the safety rotor 501 and the friction rotor 601, when the speed of the braking carriage 1 is greater than the predetermined speed.

A sliding of the braking carriage 1 on the guide 2 imposes a rotation of the friction rotor 601 about the first axis of rotation R1 and, therefore, a sliding speed of the braking carriage 1 corresponds to an angular speed of the friction rotor 601 when the braking carriage is in the sliding condition.

The safety rotor 501 is configured to rotate about a second axis of rotation R2, parallel to the first axis of rotation R1, when the safety rotor 501 and the friction rotor 601 are connected to each other in a rotationally integral manner.

The safety device 5 comprises, in addition, at least one tapered element 506 fixed to the safety rotor 501 which is configured to be inserted between the friction rotor 601 and the guide 2 for locking the safety device 5 in the safe condition.

Thanks to the tapered element 506, fixed to the safety rotor 501, which is configured to be inserted between the friction rotor 601 and the guide 2, when the safety rotor 501 is rotated by the variation mechanism 603 about its own axis of rotation R2, parallel to the axis of rotation R1 of the friction rotor 601, it is possible to obtain a braking unit 4 which is effective, which does not damage the guide 2 in the case of sudden braking. In effect, since the axis of rotation of the safety rotor 501 is fixed relative to the structure of the braking carriage 1, when the safety rotor 501 is rotated by the friction rotor 601 by the variation mechanism 603 there is an engagement of the tapered element 506 between the friction rotor 601 and the guide 2, obtaining a blocking of the further rotation of the safety rotor 501 and therefore an obstacle to the further advancement of the carriage 1.

Advantageously, the braking carriage 1 is configured to slide in the guide in two opposite directions and consequently the friction rotor 601 is configured to rotate consequently in a clockwise direction and also in an anticlockwise direction.

In order to block the sliding of the braking carriage 1, the tapered element 506 is positioned spaced from the friction rotor 601, when the braking unit 4 is in the sliding condition, and is configured to move radially towards the friction rotor 601 in such a way as to be inserted between the friction rotor 601 and the guide 2, positioning, therefore, the safety device 5 in the safe condition, when the safety rotor 501 rotates about the second axis of rotation R2.

The tapered element 506 has the shape of a wedge.

As well as tapered element 506, the safety device 5 also comprises a further tapered element 507, which is also positioned spaced from the friction rotor 601 when the braking unit 4 is in the sliding condition, which is configured to move radially towards the friction rotor 601 in such a way as to be inserted between the friction rotor 601 and the guide 2, when the safety rotor 501 rotates about the second axis of rotation R2, positioning the safety device 5 in the safe condition.

The further tapered element 507 also has the shape of a wedge.

The tapered element 506 is configured to move when the friction rotor 601 rotates in an anti-clockwise direction, the further tapered element 507 on the other hand, is configured to move when the friction rotor rotates in a clockwise direction.

The tapered element 506 and the further tapered element 507 are positioned symmetrically in the safety rotor 501 relative to the vertical, when the speed of the braking carriage 1 is less than the predetermined maximum speed.

Figure 6:
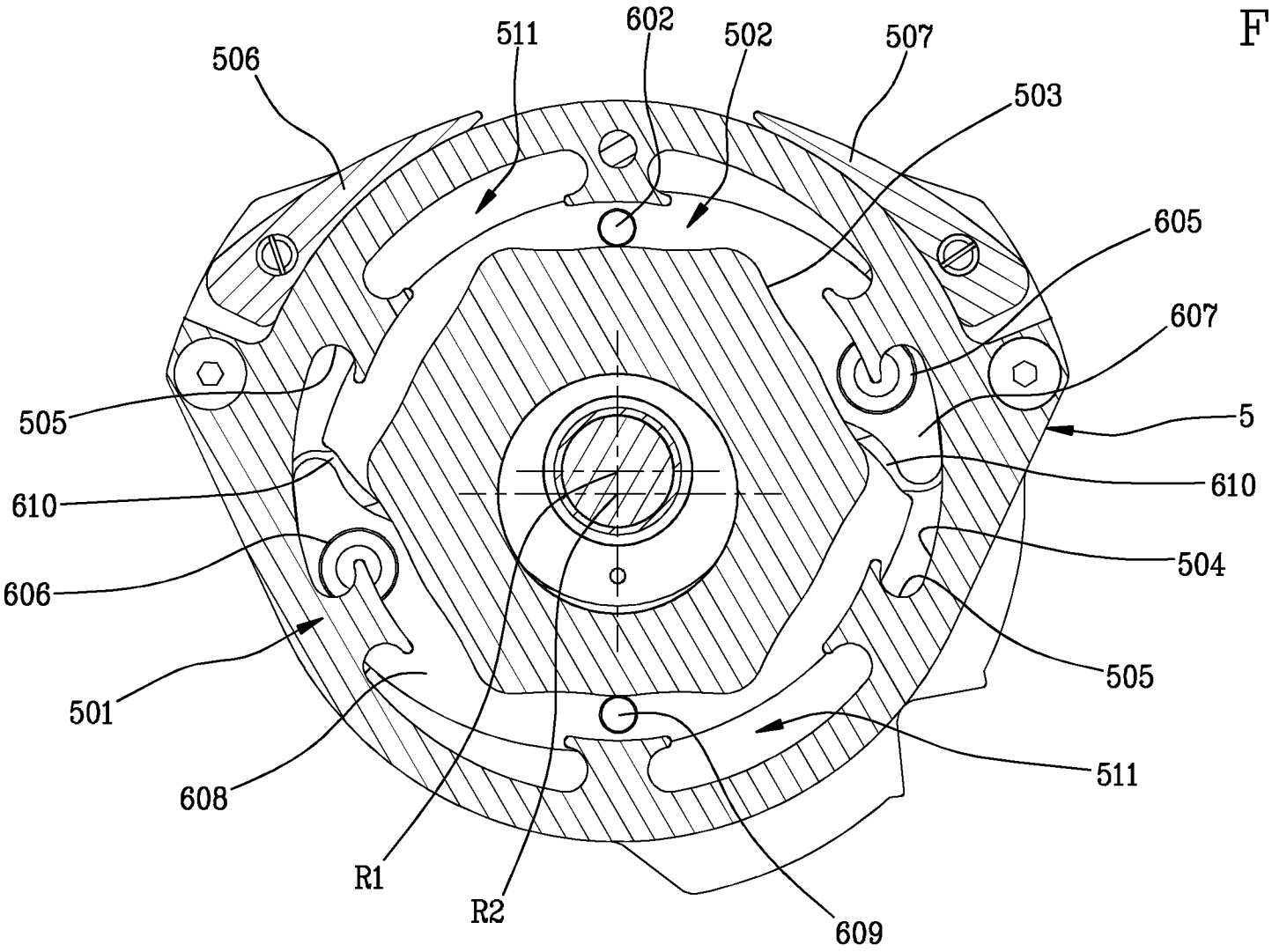
FIG. 6 is a cross-section view of the braking unit of FIG. 3 in a sliding condition.
Figure 7:
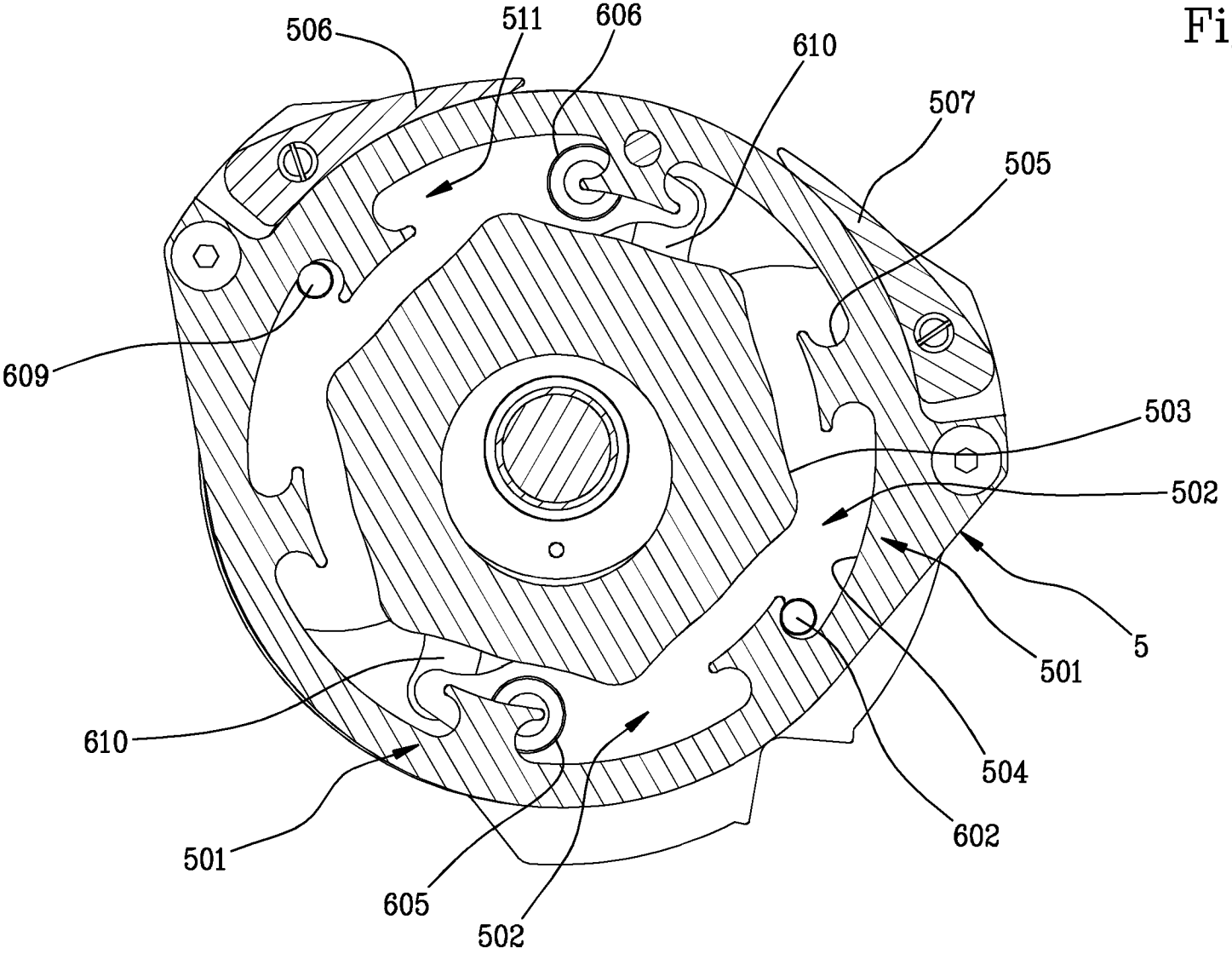
FIG. 7 is the cross-section view of the braking unit of FIG. 3 in a safe condition.
Figure 8:
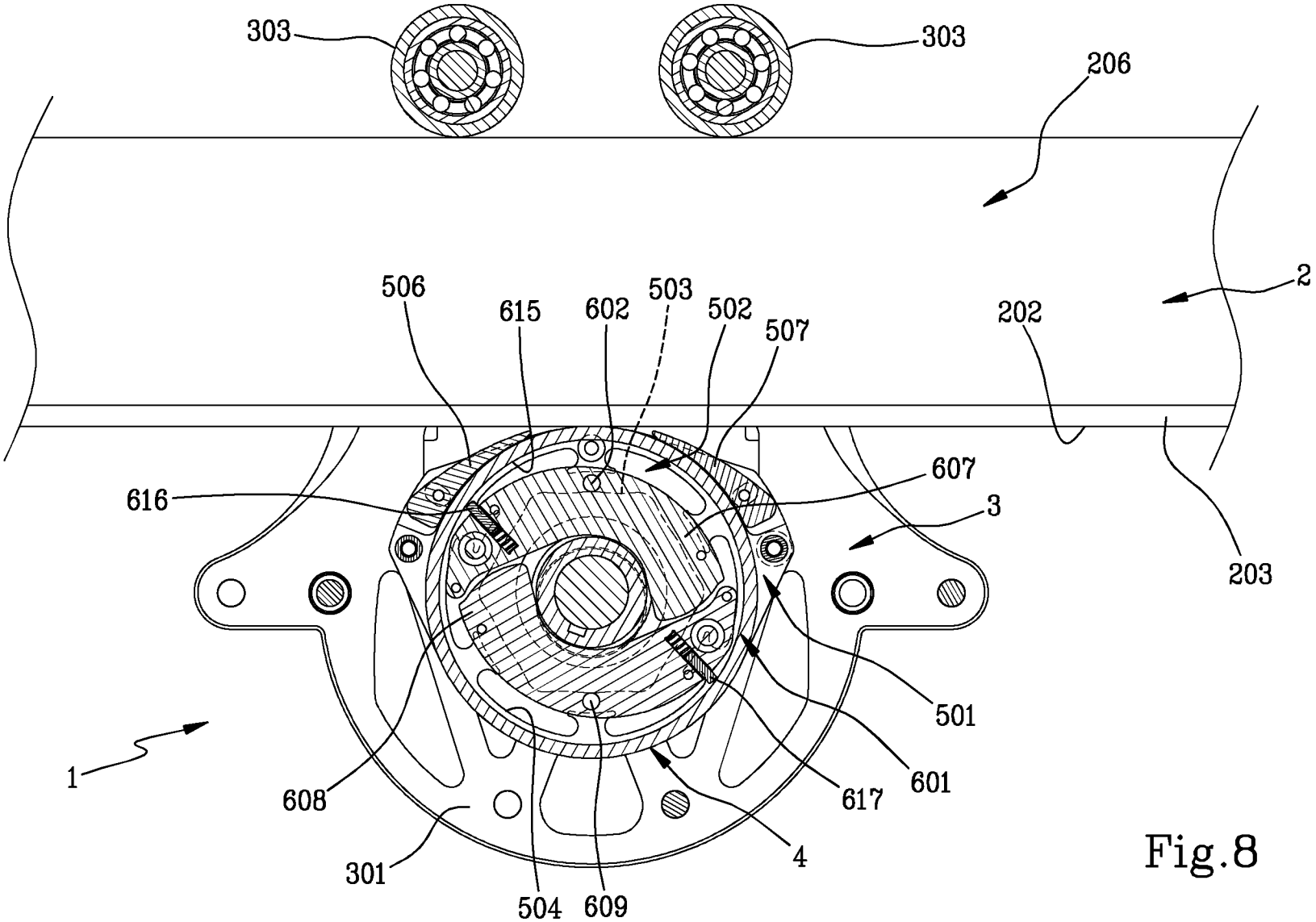
FIG. 8 is a rear view of the braking carriage of FIG. 1.

As shown in FIG. 6, the safety rotor 501 is provided with a cam profile 502 equipped with an inner cam surface 503 and an outer cam surface 504.

The detection element 6 comprises a cam follower pin 602, which is an engagement pin, which is acting in conjunction with and coupled in a slidable manner with the cam profile 502 and is connected to the friction rotor 601 by the variation mechanism 603.

In effect, the variation mechanism 603 is configured to vary a radial position of the cam follower pin 602 relative to the first axis of rotation R1 and to induce a radial movement of the cam follower pin 602 from the inner cam surface 503 to the outer cam surface 504 when the speed of the braking carriage 1 is greater than the predetermined speed.

It should be noted that the outer cam surface 504 of the safety rotor 501 has at least one locking seat 505 in which the cam follower pin 602 is configured to be locked.

When the cam follower pin 602 is locked in the locking seat 505, the friction rotor 601 and the safety rotor 501 are connected to each other in a rotationally integral manner and, therefore, the safety rotor 501 is driven in the safe condition to move in rotation about the second axis of rotation R2.

In other words, the cam follower pin 602 slides in contact with the inner cam surface 503 when the sliding speed of the braking carriage 1 is less than a predetermined speed, and is induced to move radially by the variation mechanism 603 in contact with the outer cam surface 504 when the speed exceeds the maximum predetermined speed to slide from that moment in contact with the outer cam surface 504 to the locking seat 505.

When the cam follower pin 602 is locked in the locking seat 505, the safety rotor 501 is connected in a rotationally integral manner with the friction rotor 601 and a rotation of the friction rotor 601 about the first axis of rotation R1 rotates the safety rotor 501 about the second axis of rotation R2 which causes the safety rotor 501 itself to engage with the guide 2 in the safe condition blocking the sliding of the braking carriage 1.

Since the sliding of the braking carriage 1 is locked by the interposing between the safety rotor 5 and the guide 2, in particular a base part 201 of the guide 2 as described in more detail below, the guide 2 may be designed in an ergonomic manner as a handrail for users without disabilities.

It should be noted that the guide 2 comprises a front part 205, designed to be directed in use towards a user and a rear part 206, comprising a seat 207 suitably shaped to receive an element (not illustrated) for fixing the guide 2 to a wall (not illustrated) or suitably designed pillar.

It should be noted that the relative terms mentioned in this description, and that is, front and/or rear, upper and/or lower, top and/or bottom refer to the braking carriage 1, when the braking carriage 1 is mounted on the guide 2. More in detail, the rear part 206 of the braking carriage 1 is that facing the fixing element whilst the front part 205 is that facing a user.

It should be noted that the safety rotor 501 comprises a front wall 508 and a rear wall 509, between which the friction rotor 601 is interposed, and that the cam profile 502 comprises a flat cam made by a groove in the rear wall 509.

The tapered element 506 and the further tapered element 507 of the safety device 5 each have, at a first end, a respective apical edge, rounded in shape, and at a second end, opposite the first end, a respective base. Each tapered element 506 and 507 also has an inner wall, facing towards the friction rotor 601 which has a curved shape to be able to engage in an outer surface 604 of the friction rotor 601, and a pair of lateral walls, parallel to each other, one of which is fixed to the front wall 508 and the other is fixed to the rear wall 509.

Between the front wall 508 and the rear wall 509 there is also a pair of lateral spacers 510, located in the vicinity of the tapered element 506 and the further element tapered 507, for fixing together stably the front wall 508 and the rear wall 509.

The braking unit 4 also comprises a safety sensor 7 arranged to detect the rotation of the front wall 508 of the safety rotor 5, when the safety rotor 5 is drawn in rotational movement in the safe condition, and to interrupt a power supply to the stairlift following the rotation.

The safety sensor 7 is positioned at an outer recessed portion 508*a* of the front wall 508, and is configured to intercept an edge 508*b* of the front wall 508 during the rotation. More in detail, the safety sensor 7 is a wheel contact sensor.

Considering now the rear wall 509, it should be noted that the outer cam surface 504 of the cam profile 502 comprises a plurality of elongate cradles 511 arranged equally angularly spaced on an outer portion of the rear wall 509, each cradle 511 having the locking seat 505 for receiving the cam follower pin 602 when the friction rotor 601 rotates in a clockwise direction, and a further locking seat 512 for receiving the cam follower pin 602 when the friction rotor 601 rotates in an anticlockwise direction.

It should also be noted that the inner cam surface 503 has the shape of a hexagon and that each vertex of the hexagon lies at a middle portion of a corresponding cradle 511. In this way the detachment of the cam follower pin 602 from the inner cam surface 503 is facilitated when the speed of rotation of the friction rotor 601 exceeds the predetermined maximum speed.

The detection element 6 also comprises a pair of rotation pins 605, 606 fixed to the friction rotor 601, between which a first rotation pin 605 has a third axis of rotation R3 and a second rotation pin 606 has a fourth axis of rotation R4, the axes of rotation R3 and R4 being parallel to the first axis of rotation R1.

The variation mechanism 603 of the radial position comprises in effect a pair of masses 607, 608, between which a first mass 607 has a fixed end hinged to the respective first rotation pin 605 and the second mass 608 has a fixed end hinged to the respective second rotation pin 606. The pair of masses 607 and 608 is such that the rotation of the friction rotor 601 below a predetermined angular speed keeps the pair of masses 607, 608 in a neared configuration and a rotation of the friction rotor 601 above the predetermined angular speed causes an arrangement of these masses 607 and 608 in a distanced configuration. In detail, the first mass 607 and the second mass 608 have respective holes positioned to be fitted respectively in the first rotation pin 605 and in the second rotation pin 606.

The cam follower pin 602 is arranged fixed on the first mass 607 at a predetermined distance from the respective first rotation pin 605, so that when the pair of masses 607; 608 is in the neared configuration the cam follower pin 602 is maintained in sliding engagement on the inner cam surface 503 and when the pair of masses is in the distanced configuration, the cam follower pin 602 is arranged in sliding engagement on the outer cam surface 504.

The friction rotor 601 comprises a further cam follower pin 609, which is a further engagement pin, which is arranged on the second mass 608 at a predetermined distance from the second rotation pin 606, so that when the pair of masses 607; 608 is in the neared configuration the further cam follower pin 609 is maintained in sliding engagement on the inner cam surface 503 and when the pair of masses 607 and 608 is in the distanced configuration, the further cam follower pin 609 is arranged in sliding engagement on the outer cam surface 504.

The detection device 6 comprises a pair of balancing connecting rods 610 connecting the first mass 607 and the second mass 608, each balancing connecting rod 610 having a first end fixed to the first mass 607 and a second end fixed to the second mass 608, for balancing the masses relative to each other.

In this way, the operation of the detection device 6 is not influenced by the force of gravity. In effect, advantageously, a centrifugal force acts on the pair of masses 607 and 608 which is independent of the angular position of the pair of masses 607 and 608 and which are therefore not affected by the action of the force of gravity.

The detection element 6 also comprising a further pair of masses 611; 612 positioned respectively fixed in a hinged manner to rotate with respect to the first rotation pin 605 and to the second rotation pin 606, among which a further first mass 611 is a replica of the first mass 607 and a further second mass 612 is a replica of the second mass 612. In detail, the further first mass 611 and the further second mass 612 have respective holes positioned to be fitted respectively in the same first rotation pin 605 and in the second rotation pin 606.

The further first mass 611 and the further second mass 612 are then respectively arranged stacked to the first mass 607 and the second mass 608, the first end of each balancing connecting rod 610 being respectively fixed in addition to the further first mass 611, the second end of the above-mentioned connecting rod being fixed in addition to further second mass 612, the pair of balancing connecting rods 610 being interposed between the first pair of masses 607, 608 and the further pair of masses 611, 612 in such a way as to connect in pairs the masses 607, 611 and 608, 612 to each other.

It should be noted that the friction rotor 601 comprises a cylindrical body having as its side wall the above-mentioned outer surface 604, which is cylindrical in shape. The cylindrical body is hollow and houses inside it the variation mechanism 603 of the radial position, which is integral in a rotational manner to the friction rotor 601 because the first rotation pin 605 and the second rotation pin 606 are fixed to a bottom wall 614 of the cylindrical body. The cylindrical body also has an internal lateral surface 615, which is also cylindrical in shape.

The detection element 6 also comprises a pair of elastic compression elements 616 and 617, in particular made of elastomer or by means of compression springs, between which a first end of a first elastic element 616 is fixed to the first 607 mass by the interposition of a first spring and a first end of a second elastic element 617 is fixed to the second mass 608 by the interposition of a second spring, each elastic element 616, 617 having a respective second end positioned to make contact with the inner lateral surface 615 of the friction rotor 601 during the rotation of the friction rotor 601.

The first elastic element 616 and the second elastic element 617 are in an extended configuration during the rotation of the friction rotor 601 below a predetermined angular speed in such a way as to keep the pair of respective masses 607, 608 in a neared configuration.

The first elastic element 616 and the second elastic element 617 are, on the other hand, in a compressed configuration when the pair of masses 607, 608 are in a distanced configuration.

It should be noted that the guide 2 comprises a friction surface 202 which is configured to engage with the outer surface 601 of the friction rotor 604. In detail, the friction rotor 601 is rotated by the friction between the friction surface 202 and the relative outer surface 604, when the braking carriage 1 slides in the guide 2. The friction surface 202 is a base surface of an insert 203, in particular a plate, housed in the base part 201 of the guide 2. According to a variant embodiment not illustrated, the friction surface 202 is the base surface of the base part 201.

In any case, the outer surface 604 of the friction rotor 601 is rough so that a friction between the friction rotor 601 and the friction surface 202 of the guide 2 is such as to prevent the sliding of one with respect to the other. For this purpose, the outer surface 604 has a friction coefficient such as to guarantee the rotation of the friction rotor 601.

The braking unit also comprises a first rotation shaft 8 to which the friction rotor 601 is fixed, having the first axis of rotation R1, at the opposite ends of which are fitted respective eccentric flanges 9, which are mounted eccentrically relative to the second axis of rotation R2, to which the safety rotor 502 is fixed to rotate.

The sliding unit 3 of the braking carriage 1 comprises a frame 301 with a concave shape defining a seat 302 for housing at least a part of the guide 2 and also comprises at least one upper roller 303, mounted on an upper portion (not illustrated) of the frame 101 to be rotatably engageable resting on an upper surface of a part of the head 204 of the guide 2, and at least a first pair of lower rollers 304 and a second pair of lower rollers 305 mounted in such a way as to be rotatably engaged in a rolling manner on opposite side surfaces of the base part 201 of the guide 2.

The braking carriage 1 also comprises the braking unit 4 mounted on a lower portion of the frame 301.

In detail, the lower portion of the frame 101 comprises a respective chamber 306 for housing and supporting the ends of the first rotation shaft 8 and the respective eccentric flanges 9, which are pushed towards the first rotation shaft 8 by the interposition of elastic radial fixing elements 307, for example made of elastomer.

In this way, the braking unit is supported in a rotational manner by the sliding unit 3.

The frame also comprises a seat 308 for housing a slide 309 interposed slidably in a central position between a pair of contact elastic elements 310, for example springs. The slide 309 is configured to receive a pin 513 for resetting the safety device 5. A rotation of the safety rotor 5 in the safe condition moves the reset pin 513 to slide the slide 309 in one of the two directions and therefore causes compression of one of the two elastic elements 310. At the end of the safe condition, the elastic element 310 which has been compressed will again move the slide 309 to a central position and, therefore, the braking unit 4 will again be ready to be used.

In use, when the stairlift is used by persons with reduced mobility, the stairlift is actuated by the motor-driven drive carriage which slides on the further guide and the braking carriage 1 moves in an integral manner with the drive carriage on the guide 2 by the sliding of the sliding unit 301 on the guide. More in detail, the upper roller 303 rolls on the upper surface of the head part 204 of the guide 2 and the first pair of lower rollers 304 and the second pair of lower rollers 305 roll on the opposite lateral surfaces of the base part 201 of the guide 2. The friction between the friction surface 202 of the base part 201 of the guide 2 and the outer surface 604 of the friction rotor 601 of the detection element 6 rotates the friction rotor 601 at an angular speed which corresponds to a sliding speed of the sliding unit 3.

The cam follower pin 602 of the variation mechanism 603 remains in contact with the surface of the inner cam 503 of the safety device 5 of the braking unit 4.

When the sliding speed exceeds the maximum predetermined speed, the variation mechanism 603 induces the radial movement of the cam follower pin 602, and of the further cam follower pin 609, from the inner cam surface 503 to the outer cam surface 504 since the masses of the first pair 607 and 608 and the masses of the second pair 611 and 612, which are connected together by means of the connecting rods 610, change from the neared configuration to the distanced configuration. When the cam follower pin 602, and the further cam follower pin 609, are brought into contact with the outer surface of the cam 504, they continue to follow the outer cam surface 504 to be positioned in respective locking seats 505 of the latter.

The rear wall 509 of the safety rotor 5, inside of which is formed the cam profile 502, therefore becomes integral in rotation with the friction rotor 601 and therefore the safety rotor 5 is rotated until engaging with the guide 2 in a safe condition blocking a sliding of the braking carriage 1. The tapered element 506, if the rotation is in an anti-clockwise direction, or the further element tapered 507, if the rotation is in a clockwise direction, are inserted between the guide 2 and the friction rotor 601 blocking the sliding of the braking carriage 1.

It should be noted that the rotation of the wall 508 of the safety rotor 501 moves the edge **508*b* close to the outer recessed portion 508*a* to intercept, and therefore activate, the safety sensor 7. When activated, the safety sensor 7** interrupts the power supply to the drive carriage to block the stairlift as soon as possible.

Advantageously, thanks to the braking unit 4 according to this invention, the braking carriage 1 is locked thanks to a interposing of the safety rotor 501, and in particular of the tapered element 506 or of the further tapered element 507, between the friction rotor 601 and the guide 2. The tapered element 506 and the further tapered element 507 of the safety rotor 501 are able to intervene when the braking carriage slides in a direction of travel or in the opposite direction of travel and, advantageously, it is possible to re-establish a sliding condition of the braking carriage 1 and therefore make the braking carriage operational again in the sliding condition following a locking intervention of the braking carriage. A rotation of the safety rotor 501 in the opposite direction to the rotation induced by the safe condition is in fact able to release the tapered element 506 or the further tapered element 507. The presence of the slide 309 on which the reset pin 513 engages facilitates the reverse rotation of the safety rotor 501.

It should also be noted that the intervention of the tapered elements 506, or 507, does not damage the guide 2, which may therefore always be safely gripped by a user without disabilities.

The invention claimed is:

1. A braking unit (4) for a stairlift, wherein the stairlift comprises a guide (2) and a braking carriage (1) slidable on the guide (2), the braking carriage (1) comprising the braking unit (4); wherein the braking unit (4) comprises: a safety device (5) which can be displaced to be engaged with the guide (2) from a sliding condition to a safe condition, blocking a sliding of the braking carriage (1); a detection device (6), which is configured to detect a speed of the braking carriage (1) on the guide (2) and is connected to the safety device (5) to cause the displacement of the safety device (5) into the safe condition, if the speed of the braking carriage (1) exceeds a maximum predetermined speed; wherein the safety device (5) comprises: a safety rotor (501) and wherein the detection device (6) comprises: a friction rotor (601), moved by the sliding of the braking carriage (1) in rotation independently from the safety rotor (501) about a first axis of rotation (R1) and a variation mechanism (603) acting in conjunction with and coupled with the safety rotor (501), which is configured for connecting in a rotationally integral manner the safety rotor (501 and the friction rotor (601) when the speed of the braking carriage (1) is greater than the predetermined speed; the braking unit being characterised in that the safety rotor (501) is configured for being rotated about a second axis of rotation (R2), parallel to the first axis of rotation (R1) when the friction rotor (601) and the safety rotor (501) are connected in an integral manner, the safety device (5) also comprising at least one tapered element (506) fixed to the safety rotor (501) which is configured for interposing between the friction rotor (601) and the guide (2) for locking the safety device (5) in the safe condition.

2. The braking unit according to claim 1, wherein the braking carriage (1) is configured to slide in the guide in two opposite directions and the friction rotor (601) is configured to rotate consequently in the clockwise direction and in the anticlockwise direction, and wherein the at least one tapered element (506) is arranged at a distance from the friction rotor (601) when the braking unit (4) is in the sliding condition and configured to move radially towards the friction rotor (601) and to be interposed between the friction rotor (601) and the guide (2), when the safety device (5) is in the safe condition.

3. The braking unit according to claim 2, wherein the safety device (5) further comprises a further tapered element (507), also fixed to the safety rotor (501) and arranged at a distance from the friction rotor (601) when the braking unit (4) is in the sliding condition and configured to move radially towards the friction rotor (601) and to be interposed between the friction rotor (601) and the guide (2), when the safety device (5) is in the safe condition, the at least one tapered element (506) being configured to be displaced when the friction rotor (601) rotates in the anticlockwise direction, the further tapered element being configured to move when the friction rotor (601) rotates in the clockwise direction.

4. The braking unit according to claim 1, wherein the at least one tapered element and/or a further tapered element have the shape of a wedge.

5. The braking unit according to claim 4, wherein a cam profile (502) comprises a plurality of cradles (511) which are elongated and arranged equally angularly spaced on an external portion of the rear wall (509), each cradle (511) having the at least one locking seat (505) for receiving the cam follower pin (602) when the friction rotor (601) rotates in the clockwise direction, and a further locking seat (512) to receive the cam follower pin (602) when the friction rotor rotates in the anticlockwise direction.

6. The braking unit according to claim 1, wherein the safety rotor (501) is equipped with a cam profile (502) equipped with an inner cam surface (503) and an outer cam surface (504) and wherein the detection device (6) comprises a cam follower pin (602), which is an engaging pin, acting in conjunction and slidably connected to the cam profile (502), which is connected to the friction rotor (601) by the variation mechanism (603), the latter being configured to vary a radial position of the cam follower pin (602) relative to the first axis of rotation (R1) and to induce a radial movement of the cam follower pin (602) from the inner cam surface (503) to the outer cam surface (504) when the speed of the braking carriage (1) is greater than the predetermined speed; the outer cam surface (504) having at least one locking seat (505) in which the cam follower pin (602) is configured to lock in such a way as to connect in an integral manner the safety rotor (501) and the friction rotor (601) when the cam follower pin (602) is locked in the at least one locking seat (505).

7. The braking unit according to claim 6, wherein the safety rotor (501) comprises a front wall (508) and a rear wall (509) between which the friction rotor (601) is interposed, the cam profile (502) being realised by means of a groove in the rear wall (509).

8. The braking unit according to claim 7, and comprising a safety sensor (7) arranged to detect the rotation of the front wall (508) of the safety rotor (501), when the safety rotor (501) is drawn in rotational movement in the safe condition, and to interrupt a power supply to the stairlift following the rotation.

9. The braking unit according to claim 8, wherein the safety sensor (7) is positioned at an outer recessed portion (508*a*) of the front wall (508), and is configured to intercept an edge (508*b*) of the front wall (508) during the rotation.

10. The braking unit according to claim 1, wherein the detection device (6) comprises a pair of rotation pins (605; 606) fixed to the friction rotor (601), among which a first rotation pin (605) has a third axis of rotation (R3) and a second rotation pin (606) has a fourth axis of rotation (R4), which are parallel to the first axis of rotation (R1), the variation mechanism (603) comprising a pair of masses (607; 608), among which a first mass (607) has a fixed end hinged to the respective first rotation pin (605) and a second mass (606) has a fixed end hinged to the respective second rotation pin (607), the pair of masses being such that the rotation of the friction rotor (601) below a prefixed angular speed maintains such pair of masses (607; 608) in a neared configuration and a rotation of the friction rotor above the predetermined angular speed causes an arrangement of such masses (607; 608) in a distanced configuration.

11. The braking unit according to claim 10, wherein the cam follower pin (602) is arranged on the first mass (607) at a predetermined distance from the respective first rotation pin (605), so that when the pair of masses (607; 608) is in the neared configuration the cam follower pin (602) is maintained in sliding engagement on the inner cam surface (503) and when the pair of masses (607; 608) is in a distanced configuration, a cam follower pin (602) is arranged in sliding engagement on an outer cam surface (504).

12. The braking unit according to claim 11, wherein the friction rotor (601) comprises a further cam follower pin (609), which is a further engagement pin, which is arranged on the second mass (608) at a predetermined distance from the second rotation pin (606), so that when the pair of masses (607; 608) is in the neared configuration the further cam follower pin (606) is maintained in sliding engagement on the inner cam surface (503) and when the pair of masses (607; 608) is in the distanced configuration, the further cam follower pin (606) is arranged in sliding engagement on the outer cam surface (504).

13. The braking unit according to claim 11, wherein the detection device (6) comprises a pair of balancing connecting rods (610) connecting the first mass (607) and the second mass (608), each balancing connecting rod (610) having a first end fixed to the first mass (607) and a second end fixed to the second mass (608).

14. The braking unit according to claim 13, and comprising a further pair of masses (611; 612) positioned respectively fixed in a hinged manner to rotate with respect to the first rotation pin (605) and to the second rotation pin (606), among which a further first mass (611) is a replica of the first mass (607) and a further second mass (612) is a replica of the second mass (608), the further first mass (611) and the further second mass (612) being respectively positioned stacked on the first mass (607) and on the second mass (608).

15. The braking unit according to claim 14, wherein the first end of each balancing connecting rod (610) is respectively fixed in addition to the further first mass (611) and the second end of the above-mentioned the connecting rod is fixed in addition to further second mass (612), the pair of balancing connecting rods (610) being interposed between the first pair of the masses (607; 608) and the further pair of the masses (611; 612).

16. The braking unit according to claim 10, wherein the friction rotor (601) comprises a cylindrical body which is hollow and houses inside it the variation mechanism (603) for varying the radial position, which is integral in rotation with the friction rotor (601), and wherein the cylindrical body has a bottom wall (614) to which the first rotation pin (605) and the second rotation pin (606) are fixed and an inner lateral surface (615), which is cylindrical.

17. The braking unit according to claim 16, wherein the detection device (6) also comprises a pair of elastic compression elements (616; 617), between which a first end of a first elastic element (616) (607) is fixed to the first mass and a first end of a second elastic element (617) is fixed to the second mass (608).

18. The braking unit according to claim 17, wherein each elastic element (616; 617) has a respective second end positioned to make contact with the inner lateral surface (615) and is in a extended condition during the rotation of the friction rotor (601) under the predetermined angular speed to maintain the pair of masses (607; 608) in a close configuration and it is in a compressed configuration when the pair of masses (607; 608) is in a spaced apart configuration.

19. The braking unit according to claim 1, wherein the friction rotor (601) comprises a cylindrical body which is hollow and houses inside it the variation mechanism (603) for varying the radial position, which is integral in rotation with the friction rotor (601).

20. The braking unit according to claim 19, wherein the cylindrical body comprises an outer surface (604) and the guide (2) comprises a friction surface (202) which is configured to be engaged with the outer surface (604), the friction rotor (601) being drawn in rotation by the friction between the friction surface (202) and the outer surface (604) when the braking carriage (1) slides in the guide (2).

* * * * *